US006036540A

United States Patent [19]

Beloritsky

[11] Patent Number: 6,036,540

[45] Date of Patent: Mar. 14, 2000

[54] COAXIAL CONNECTOR WITH RING CONTACT HAVING CANTILEVERED FINGERS

[75] Inventor: Victor Beloritsky, North Andover, Mass.

[73] Assignee: The Whitaker Corporation, Wilmington, Del.

[21] Appl. No.: 09/057,667

[22] Filed: Apr. 9, 1998

Related U.S. Application Data

[60] Provisional application No. 60/048,006, May 29, 1997.

[51] Int. Cl.[7] ..... H01R 9/05

[52] U.S. Cl. ..... 439/582

[58] Field of Search ..... 439/891, 902, 439/578–585

[56] References Cited

U.S. PATENT DOCUMENTS

| | | | |
|---|---|---|---|
| 4,046,052 | 9/1977 | Nordstrom | 411/1 |
| 4,655,534 | 4/1987 | Stursa | 439/582 |
| 4,779,948 | 10/1988 | Wais et al. | 350/96.2 |
| 4,848,346 | 7/1989 | Crawford | 128/419 P |
| 5,217,391 | 6/1993 | Fisher, Jr. | 439/578 |
| 5,316,499 | 5/1994 | Scannelli et al. | 439/534 |
| 5,489,222 | 2/1996 | Moyer et al. | 439/748 |

*Primary Examiner*—Michael L. Gellner
*Assistant Examiner*—Barry M. L. Standig

[57] ABSTRACT

A coaxial connector including a substantially cylindrical ring contact and a receptacle shell. The ring contact comprises a substantially cylindrical first end and a second end that includes a channel-shaped wall that forms a pair of opposing cantilevered beams disposed in substantially tangential-relation to the channel-shaped wall. The receptacle shell comprises a housing having a bore that extends through the receptacle shell and is defined by an internal wall. The internal wall of the housing also defines a shoulder formed by a portion of the wall that projects radially inwardly so as to be transversely oriented relative to the bore. Two transverse recesses are formed within the wall, substantially adjacent to an upper portion of the transverse projection. The two recesses are disposed in spaced-relation to one another within the bore such that when the ring contact is disposed within the bore of the housing, the cantilevered beams each electrically and mechanically engage a portion of the wall that is adjacent to each of the two transverse recesses.

8 Claims, 3 Drawing Sheets

COAXIAL CONNECTOR WITH RING CONTACT HAVING CANTILEVERED FINGERS

This application claims the benefit under 35 USC §119(e) of U.S. Provisional Application Ser. No. 60/048,006, filed May 29, 1997.

FIELD OF THE INVENTION

The present invention generally relates to electrical connectors, and more particularly to coaxial connectors.

BACKGROUND OF THE INVENTION

Coaxial interconnection systems, such as radio frequency (RF) interconnection systems are well known in the art. For example, U.S. Pat. No. 4,655,534, issued to Stursa, discloses a miniature right angle coaxial connector that enables a coaxial cable to be connected to a standard SMB mating connector. A stamped and formed interface is housed in the connector which interface has outwardly oriented multiple spring leaf barbs for securing the interface to the inner surface of the connector. Additionally, inwardly oriented multiple spring leaf barbs are provided to secure a dielectric to the interface. The multiple spring leaf barbs on the interface makes it possible to die cast, instead of machine, the connector housing parts, and eliminates the need for precious metal plating to insure conductivity between the parts.

U.S. Pat. No. 5,489,222, issued to Moyer et al., provides a miniature bulkhead connector having an anti-rotational mechanism for preventing rotation of a center conductor during mating with a mating coaxial connector. Moyer's miniature bulkhead connector includes a metal housing arranged to be mounted to a bulkhead and an insulating insert in a cavity within the housing. The insert has a central hole positioned to align with the longitudinal axis of the insert. A series of ribs are formed on the interior surface of the central hole, parallel with the axis, and are arranged to form channels between adjacent ribs. The channels are sized to receive edges that project from opposite sides of the contact. The edges slide into the channels allowing the contact to freely move along the longitudinal axis but will not permit relative rotation thereof. Since there are a number of channels, there is a similar number of angular positions from which the contact may be inserted into the insulating insert.

U.S. Pat. No. 5,217,391, issued to Fisher, provides a coaxial connector assembly including a plug and jack having respective inner and outer conductors mateable to a mating interface. The mating interface includes a plurality of regions A, B, C of mismatched impedance. Each has a varying axial length that is defined by diameter changes of the inner and outer conductors of the plug and jack, between respective dielectric bodies thereof upon mating. A reduced diameter portion of the plug's outer conductor, inwardly from its leading end, corresponds with an increased diameter of the plug's inner conductor, and is engaged by the leading ends of spring arms of the jack's outer conductor. The leading ends of the spring arms engage the inward surface of the reduced diameter portion of the plug's outer conductor within a range of axial locations accommodating variations in the locations of the plug and jack upon full mating. The reduced diameter portion can be defined by a conductive sleeve force-fit within a front shell, disposed forwardly of the dielectric body containing the inner conductor of the plug, until its leading edge coincides axially with a shoulder of the plug's inner conductor, between the pin contact section and the large diameter body section.

None of the foregoing prior art has been found to be completely satisfactory.

SUMMARY OF THE INVENTION

The present invention provides a coaxial connector that includes a ring contact and a receptacle shell. The ring contact comprises a substantially cylindrical first end and a second end that includes a channel-shaped wall that forms a pair of opposing cantilevered beams disposed in substantially tangential-relation to the channel-shaped wall. The receptacle shell comprises a housing having a bore that extends through the receptacle shell and is defined by an internal wall. The internal wall of the housing also defines a shoulder formed by a portion of the wall that projects radially inwardly so as to be transversely oriented relative to the bore. Two transverse recesses are formed within the wall, substantially adjacent to an upper portion of the transverse projection. The two recesses are disposed in spaced-relation to one another within the bore such that when the ring contact is disposed within the bore of the housing, the cantilevered beams each electrically and mechanically engage a portion of the wall that is adjacent to each of the two transverse recesses. Preferrably, the ring contact also includes a free edge that is longitudinally disposed between the first and the second ends thereof, and transversely disposed between the opposing cantilevered beams. In this way, when the ring contact is disposed within the bore of the housing and the cantilevered beams each electrically and mechanically engage the portion of the wall that is disposed adjacent to each of the two transverse recesses, the free edge of the ring contact abuts a portion of the transverse projection thereby capturing the ring contact within the receptacle shell.

BRIEF DESCRIPTION OF THE DRAWINGS

These features of the present invention will be more fully disclosed in, or rendered obvious by, the following detailed description of the preferred embodiment of the invention, which is to be considered with the accompanying drawings wherein like numbers refer to like parts and further wherein:

FIG. 3 is a rear view of the coaxial connector shown in FIG. 1;

DETAILED DESCRIPTION OF THE PREFERRED EMBODIMENT

Figure 1:
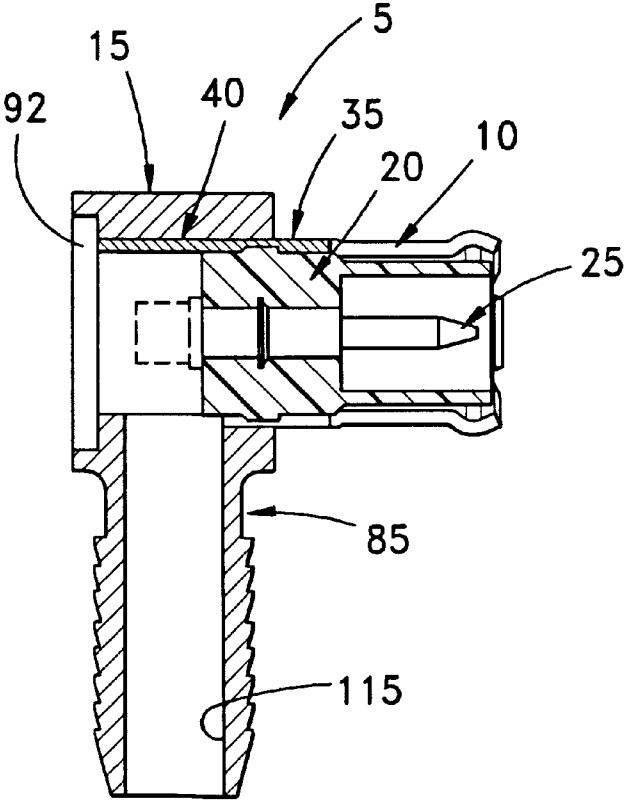
FIG. 1 is a side elevational view, partially in section, of a coaxial connector formed in accordance with the present invention.

FIG. 1 shows a coaxial connector 5 formed in accordance with the present invention comprising a ring contact 10, a housing 15, an insulating insert 20 and a center contact 25.

More particularly, and referring to FIGS. 2 through 5, ring contact 10 comprises a substantially tubular shape, and may be manufactured by either stamping and forming or screw machining a spring quality metal, such as beryllium copper or the like. Ring contact 10 includes a connector mating portion 30, a transition portion 35, and a housing mating portion 40. Connector mating portion 30 comprises a plurality of cantilevered fingers 45 that are arranged in circumferential-relation about the longitudinal axis of ring contact 10. Each finger 45 projects longitudinally outwardly from one end of transition portion 35. An electrical interface protrusion 50 is formed at a free end 55 of each finger 45.

Figure 6:
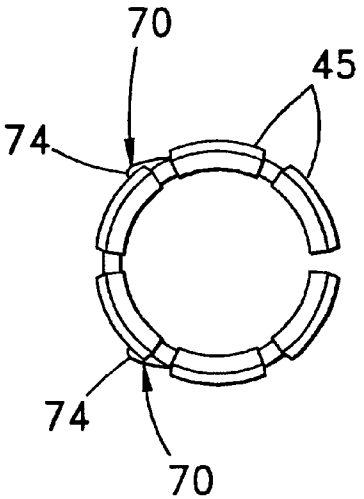
FIG. 6 is a front view of the ring contact illustrated in FIG. 4.
Figure 4:
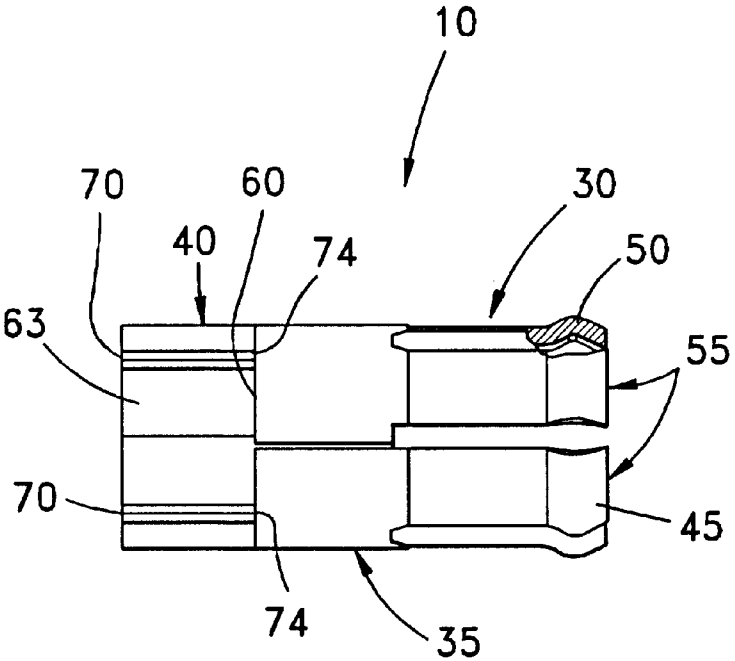
FIG. 4 is a side elevational view of a ring contact formed in accordance with the present invention.
Figure 5:
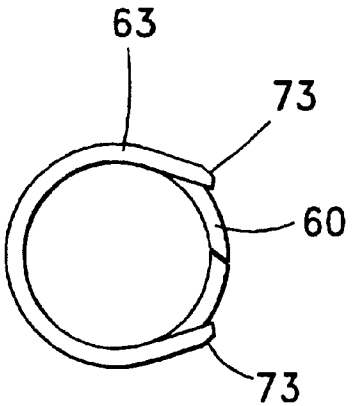
FIG. 5 is a rear view of the ring contact illustrated in FIG. 4.

Transition portion 35 is substantially cylindrically shaped, having plurality of fingers 45 projecting longitudinally-outwardly from one end thereof and housing mating portion 40 projecting longitudinally-outwardly from the other end. A segment-shaped free edge 60 of transition portion 35 is disposed at the junction of housing mating portion 40 and transition portion 35 (FIG. 5). Housing mating portion 40 projects longitudinally-outwardly from transition portion 35, and oppositely directed relative to plurality of fingers 45. Housing mating portion 40 comprises a semi-cylindrical, channel-shaped wall 63 that defines an opening adjacent to segment-shaped free end 60. The opposing free ends of channel-shaped wall 63 form a pair of confronting cantilevered beams 70. Beams 70 project outwardly in substantially tangential-relation to the curved portion of channel-shaped wall 63 so as to protrude beyond the circumference of ring contact 10 (FIGS. 5 and 6). Preferably, beams 70 form an approximately 25–35 degree included angle therebetween. A chamfered edge 73 is provided at a first end of each of beams 70 so as to aid in the insertion of ring contact 10 into housing 15, as will hereinafter be disclosed in further detail. A second end 74 of each beam 70 is disposed adjacent to segment-shaped free end 60 of transition portion 35. It will be understood that beams 70 may be biased so as to deflect inwardly toward the longitudinal axis of ring contact 10.

Referring once more to FIGS. 1–3, insulating insert 20 comprises a cylindrically shaped dielectric plug that is sized so as to be slidingly received within ring contact 10. Insert 20 includes a central bore 82 (FIG. 3) that is sized to receive center contact 25. Center contact 25 may be either male or female, and is cylindrically shaped so as to be slidingly received within central bore 82 of insert 20.

Figure 7:
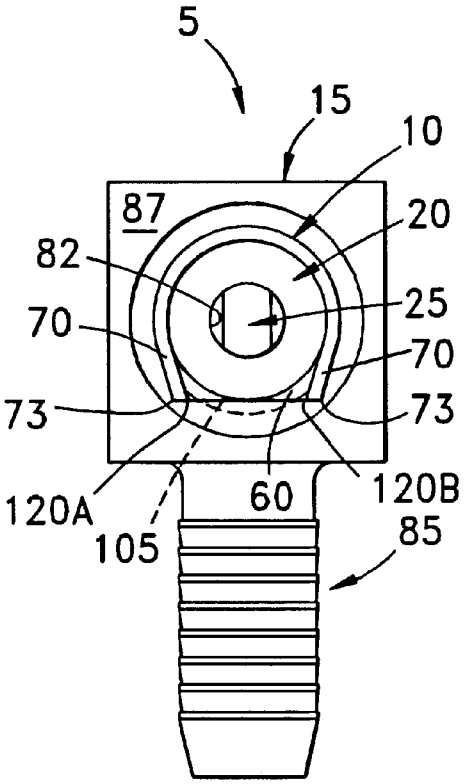
FIG. 7 is a front elevational view of a housing formed in accordance with the present invention.
Figure 2:
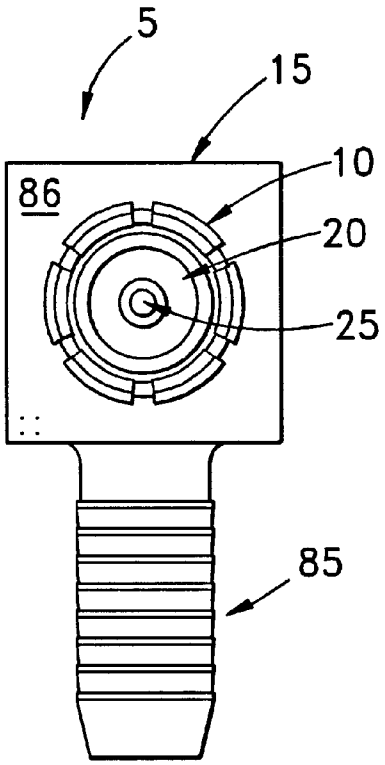
FIG. 2 is a front view of the coaxial connector shown in FIG. 1.
Figure 8:
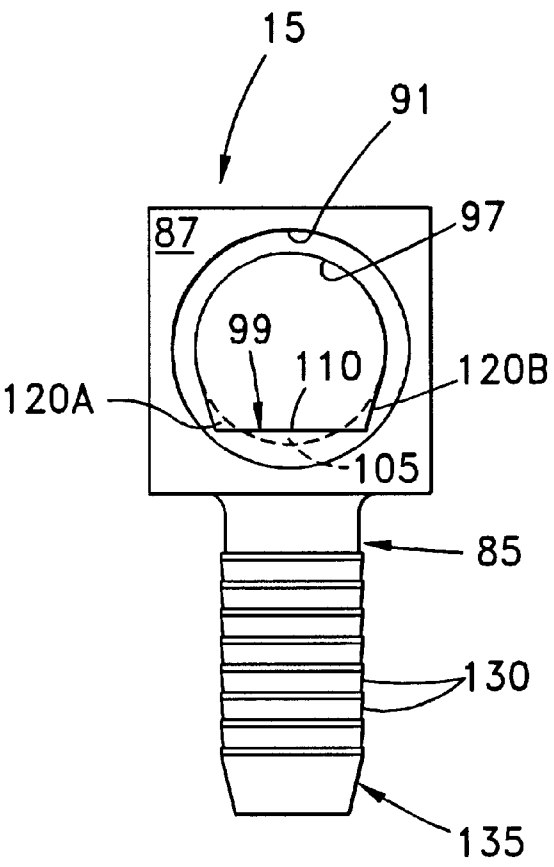
FIG. 8 is a rear view of the housing illustrated in FIG. 7.
Figure 9:
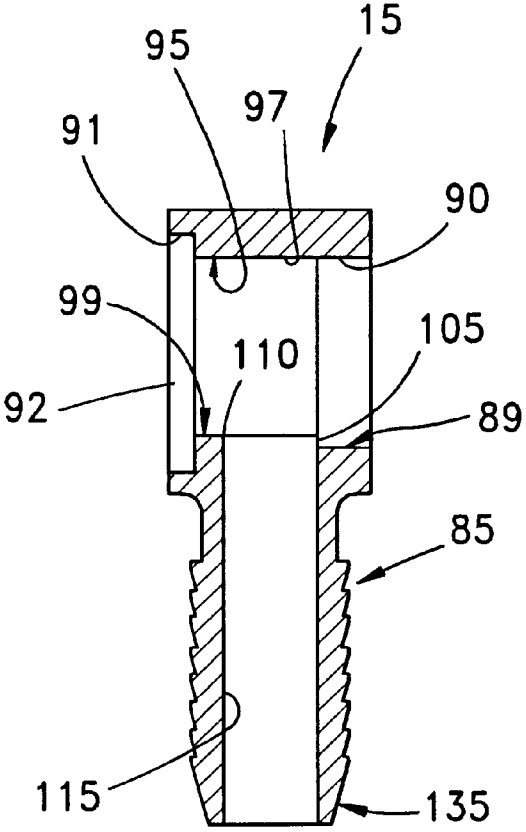
FIG. 9 is a cross-sectional view of the housing illustrated in FIG. 7, as taken along line 9—9 in FIG. 7.
Figure 7:
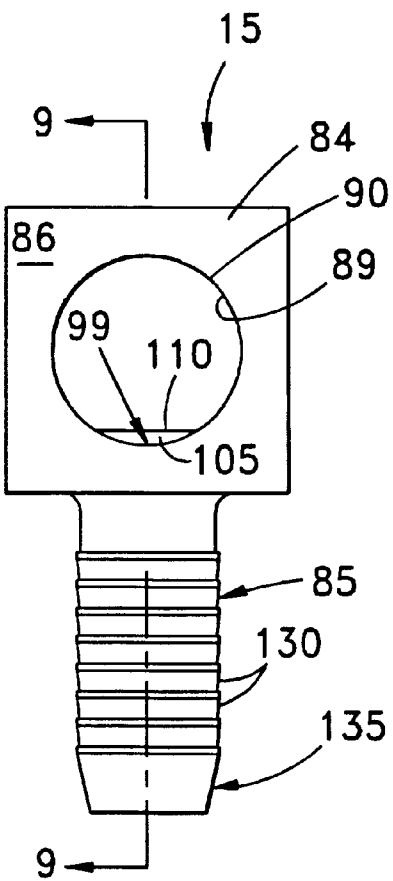

Referring now to FIGS. 7, 8, and 9, housing 15 comprises a upper shell 84 and a board mount 85. More particularly, housing may be manufactured from any one of the various metals known in the art for use in either screw machining or die casting operations. Upper shell 84 includes a front side 86 and a rear side 87. A bore 89 extends into front side 86, and is defined by a substantially cylindrical, front internal wall 90. Preferrably, bore 89 is sized to be slightly larger than the outer diameter of housing mating portion 40 of ring contact 10, but smaller than the distance that beams 70 protrude beyond the circumference of ring contact 10. A counterbore 91 extends into rear side 87 of upper shell 84, and is defined by a substantially cylindrical, rear internal wall 92. Typically, counterbore 91 is larger in diameter than bore 89. A central bore 95 is positioned between bore 89 and counterbore 91, and is defined by a "U-shaped" wall 97 and a rectlinear protrusion 99 that projects into the void defined by central bore 95.

More particularly, U-shaped wall 97 comprises the same diameter as front internal wall 90 of bore 89. Protrusion 99 comprises a relatively flat surface 110 that is oriented radially-inwardly relative to the logitudinal axis of central bore 95 so as to define a chord through central bore 95. Protrusion 99 also defines a through hole 115 that opens into central bore 95 and extends from flat surface 110 throughout the length of board mount 85 (FIG. 9). The front side portion of protrusion 99 defines a front internal shoulder 105 that extends transversely across bore 89, at the beginning of central bore 95 (FIGS. 7 and 9). Two centrally disposed internal shoulders 120A and 120B are formed by recesses that are defined by the interface between U-shaped wall 97 and the front of relatively flat surface 110 (FIG. 8). Internal shoulders 120A and 120B are positioned above flat surface 110 of protrusion 95 and first internal shoulder 97, and are disposed in spaced-apart relation to one another.

Board mount 85 comprises a substantially elongate, tubular shape, and projects outwardly from a side of housing 15. A stepped outer surface 130 is adapted to mechanically and electrically engage the walls defining a plated-through-hole disposed in a printed circuit board (not shown). Board mount 85 comprises a chamfered end 135 that aids in reducing the insertion force associated with positioning board mount 85 in the printed circuit board.

Referrring again to FIGS. 1–3, ring contact 10 is assembled to housing 15 in the following manner. First, insert 20 is located within ring contact 10. It will be understood that insert 20 is positioned within ring contact 10 so as to be fully disposed within transition portion 35 and connector mating portion 30 (FIG. 1). Typically, center contact 25 is disposed within bore 82 of insert 20 prior to positioning insert 20 within ring contact 10. Ring contact 10 is then oriented so as to position housing mating portion 40 in coaxially aligned confronting-relation to bore 89 of housing 15. In this arrangement, housing 15 is oriented so as to position front internal shoulder 105 in confronting-relation to segment-shaped free edge 60 of ring contact 10. Ring contact 10 is then moved toward housing 15 so that housing mating portion 40 enters bore 89.

As this occurs, chamfered edges 73 of cantilevered beams 70 engage portions of wall 90 so as to substantially elastically deflect beams 70 inwardly toward the longitudinal axis of ring contact 10. At this point in the assembly, beams 70 are biased inwardly so that housing mating portion 40 substantially conforms to the shape of wall 90. It will be understood that mechanial energy is stored in each beam 70 as a result of their inward deflection.

Housing mating portion 40 of ring contact 10 continues to slide through bore 89, along wall 90, and through central bore 95, along U-shaped wall 97, until segment-shaped free edge 60 engages front internal shoulder 105 (FIG. 3). As this occurs, second end 74 of each beam 70 slips past the front edge of protrusion 99 and over flat surface 110. When this happens, cantilevered beams 70 spring outwardly so as to engage the portions of U-shaped wall 97 that defines the recesses forming centrally disposed internal shoulsers 120A and 120B, thereby mechanically capturing ring contact 10 within housing 15. Significantly, since the transverse distance between the portions of U-shaped wall 97 that define the recesses forming centrally disposed internal shoulsers 120A and 120B is smaller than the transverse distance between beams 70, beams 70 engage and are biased against U-shaped wall 97. As a result of this construction, the stored energy within biased beams 70 provides for the exertion of mechanical force against U-shaped wall 97. Advantageously, this mechanical force provides for enhanced electrical conductivity between ring contact 10 and housing 15. At the same time, segment-shaped free edge 60 of transition portion 35, abuts and loosely engages front internal shoulder 105 so as to capture ring contact 10 within housing 15.

It is to be understood that the present invention is by no means limited to the precise constructions herein disclosed and shown in the drawings, but also comprises any modifications or equivalents within the scope of the claims.

What is claimed is:

1. A coaxial connector comprising:

a ring contact including a first end and a second end, said first end is substantially cylindrically shaped and said second end comprises a housing mating portion including a channel-shaped wall forming opposing cantilevered beams disposed in substantially tangential-relation to said channel-shaped wall; and a housing having a receptacle shell comprising an internal wall that defines a cylindrically shaped bore extending through said receptacle shell, said internal wall also defining a first internal shoulder formed by a transversely oriented projection extending into said bore from said wall and two transverse recesses formed within said wall and above said projection, said two recesses being disposed within said bore wherein said first internal shoulder and said two transverse recesses are disposed in substantially parallel-spaced-relation to one another such that when said ring contact is disposed within said bore of said housing, said cantilevered beams each electrically and mechanically engage a portion of said wall that is disposed adjacent to each of said two transverse recesses.

2. A coaxial connector according to claim 1 wherein said ring contact includes a free edge longitudinally disposed between said first and said second ends and transversely disposed between said opposing cantilevered beams so that when said ring contact is disposed within said bore of said housing and said cantilevered beams each electrically and mechanically engage said portion of said wall that is disposed adjacent to each of said two transverse recesses, said free edge of said ring contact abuts said first internal shoulder.

3. A coaxial connector according to claim 2 wherein said first end comprises a plurality of circumferentially arranged cantilevered fingers adapted to electrically and mechanically engage a corresponding mating connector.

4. A coaxial connector according to claim 3 wherein said receptacle shell defines a plurality of internal bores adapted to receive said ring contact.

5. A coaxial connector according to claim 4 wherein said internal bores are defined within said receptacle shell.

6. A coaxial connector according to claim 5 wherein said transverse projection is centrally disposed within said bore and comprises a flat surface that forms a chord across a portion of said bore.

7. A coaxial connector comprising:

a substantially cylindrical ring contact defining a first end and a second end, said second end comprising a channel-shaped wall that forms a pair of opposing cantilevered beams disposed in substantially tangential-relation to said channel-shaped wall; and a housing having a receptacle shell comprising a bore extending through said receptacle shell and being defined by an internal wall, said internal wall also defining a shoulder formed by a portion of said wall that projects radially inwardly into said bore so as to be transversely oriented relative to said bore and two transverse recesses formed within said wall, substantially adjacent to an upper portion of said projection, said two recesses being disposed in spaced-relation to one another within said bore such that when said ring contact is disposed within said bore of said housing, said cantilevered beams each electrically and mechanically engage a portion of said wall that is adjacent to each of said two transverse recesses.

8. A coaxial connector according to claim 7 wherein said ring contact includes a free edge longitudinally disposed between said first and said second ends and transversely disposed between said opposing cantilevered beams so that when said ring contact is disposed within said bore of said housing and said cantilevered beams each electrically and mechanically engage said portion of said wall that is disposed adjacent to each of said two transverse recesses, said free edge of said ring contact abuts a portion of said transverse projection.

* * * * *